US008333045B2

(12) United States Patent
Lung

(10) Patent No.: US 8,333,045 B2
(45) Date of Patent: Dec. 18, 2012

(54) ARCHITECTURAL STRUCTURE

(75) Inventor: Bruce Lung, Toledo, OH (US)

(73) Assignee: Bruce Lung, Toledo, OH (US)

( * ) Notice: Subject to any disclaimer, the term of this patent is extended or adjusted under 35 U.S.C. 154(b) by 305 days.

(21) Appl. No.: 12/380,837

(22) Filed: Mar. 4, 2009

(65) Prior Publication Data

US 2009/0223156 A1 Sep. 10, 2009

Related U.S. Application Data

(60) Provisional application No. 61/068,274, filed on Mar. 6, 2008.

(51) Int. Cl.
*E04B 1/74* (2006.01)

(52) U.S. Cl. ..... 52/405.3; 52/404.2; 52/504; 52/568

(58) Field of Classification Search ..... 52/405.1–405.4, 52/503, 504, 404.2, 404.3, 404.4, 404.5, 52/309.7, 309.12, 309.17, 568, 600
See application file for complete search history.

(56) References Cited

U.S. PATENT DOCUMENTS

| | | | | |
|---|---|---|---|---|
| 680,138 | A | | 8/1901 | Fenner |
| 805,478 | A | | 11/1905 | Lorscheider |
| 869,770 | A | | 10/1907 | Birnstock |
| 2,344,206 | A | | 3/1944 | Forni |
| 2,453,466 | A | | 4/1944 | Slobodzian |
| 2,624,193 | A | | 1/1953 | Larson |
| 2,647,392 | A | | 8/1953 | Wilson |
| 2,701,464 | A | | 2/1955 | Kyle et al. |
| 3,187,694 | A | | 6/1965 | Crookston et al. |
| 3,724,141 | A | | 4/1973 | Kelleher |
| 4,018,018 | A | | 4/1977 | Kosuge |
| 4,075,808 | A | | 2/1978 | Pearlman |
| 4,510,725 | A | | 4/1985 | Wilson |
| 4,514,949 | A | | 5/1985 | Crespo |
| 4,854,097 | A | | 8/1989 | Haener |
| 5,487,526 | A | | 1/1996 | Hupp |
| 5,491,945 | A | * | 2/1996 | Meirick ..... 52/309.11 |
| 5,644,871 | A | | 7/1997 | Cohen |
| 5,729,944 | A | | 3/1998 | De Zen |
| 5,822,939 | A | * | 10/1998 | Haener ..... 52/405.2 |
| 6,032,424 | A | | 3/2000 | Dial, Jr. |
| 6,036,397 | A | * | 3/2000 | Goto ..... 403/268 |
| 6,223,491 | B1 | | 5/2001 | Dial, Jr. |

* cited by examiner

*Primary Examiner* — William Gilbert
(74) *Attorney, Agent, or Firm* — Emch, Schaffer, Schaub & Porcello Co., L.P.A.

(57) ABSTRACT

An architectural concrete structure and a wall system formed with a plurality of architectural concrete structure wherein each block has first and second cement sections spaced apart and joined together with steel reinforcing bars and tubular members filled with cement. The first and second sections have parallel outer wall surfaces and inner wall surfaces which taper outwardly in an upward direction. Foam insulation is secured to each of the tapering wall surfaces, which insulation members define a tapered passageway extending through the length of the structure.

22 Claims, 2 Drawing Sheets

ARCHITECTURAL STRUCTURE

CROSS REFERENCE TO RELATED APPLICATIONS

This application claims the benefit of U.S. provisional patent application Ser. No. 61/068,274 filed on Mar. 6, 2008.

BACKGROUND OF THE INVENTION

The present application is directed to a new design of architectural concrete structure and to a wall system formed by a plurality of such structures. Concrete blocks are used extensively in building construction in a wide variety of designs. Prior art blocks and block systems for forming walls include the following U.S. Pat. Nos. 2,647,392; 2,701,464; 4,018,018; 4,075,808; 4,514,949; 4,854,097; 6,032,424; and 6,223,491.

Concrete blocks are heavy to handle and do not provide good insulating characteristics. U.S. Pat. No. 4,854,097 discloses a building block having improved insulating characteristics in which at least a part of the volume within the concrete is filled with highly insulating foam.

It is an object of the present invention to provide a an architectural concrete structure and a system for forming walls or other structures in which the components have good insulating characteristics and has a large central, open passageway to provide a structure having lower weight than would be expected for the size of the component formed and having good insulating characteristics.

Other objects and advantages of the present invention will become apparent to those skilled in the art upon a review of the following detailed description of the preferred embodiments and the accompanying drawings.

SUMMARY OF THE INVENTION

The invention is directed to an architectural concrete structure and a wall system formed with a plurality of architectural concrete structure wherein each block has first and second cement sections spaced apart and joined together with steel reinforcing bars and tubular members filled with cement. The first and second sections have parallel outer wall surfaces and inner wall surfaces which taper outwardly in an upward direction. Foam insulation is secured to each of the tapering wall surfaces, which insulation members define a tapered passageway extending through the length of the structure.

DETAILED DESCRIPTION OF THE INVENTION

Figure 1:
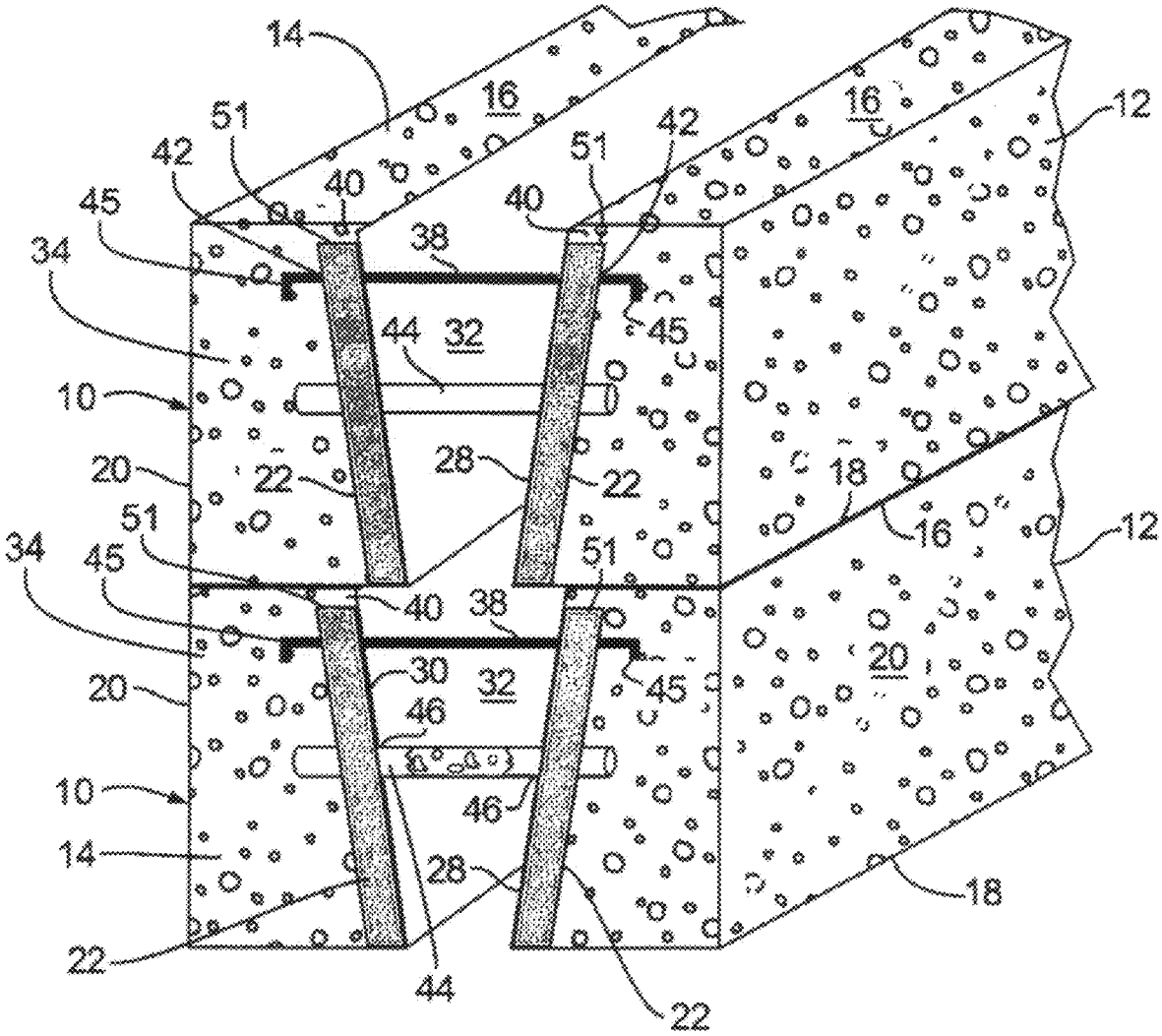
FIG. 1 is a perspective view showing two architectural concrete structures of the present invention with the upper structure resting upon the lower structure.

Referring to the drawings there is shown in FIG. 1 two architectural concrete structures 10 of the present invention including an upper structure stacked upon a lower structure 10. The structure 10 extends along a longitudinal path from a first end 34 to a second end 36 and includes a first section 12 of poured Portland cement or concrete and a second section 14 of Portland cement or concrete. The first section 12 and second section 14 are spaced apart from one another and each has an upper surface 16 and a lower surface 18 extending between the first end 34 and second end 36. The first section

12 includes a flat outer wall surface 20 extending longitudinally along a path parallel to axis A from the first end 34 to the second end 36 and extending in height from the lower surface 18 to the upper surface 16. The second section 14 has an outer wall surface 20 which also extends from the first end 34 to the second end 36 and in height from the lower surface 18 to the upper surface 16. Axis A defines the central longitudinal axis of the concrete 10. The outer wall surfaces 20 are parallel to each other.

As can be seen in FIG. 1, the first section 12 and the second section 14 each has an inner wall surface 22, each of which is disposed at an angle flaring away from one another as they extend upwardly from the lower surface 18 toward the upper surface 16. The included angle between the respective inner wall surfaces 22 and the lower surface 18 is approximately 75°±10°. Such inner wall surfaces 22 extend between the first end 34 and second end 36 of their respective first section 12 and second section 14. Preferably the respective inner wall surfaces 22 extend upwardly from their respective lower surfaces 18, flaring outwardly away from each other but do not extend completely to the respective upper surfaces 16.

Positioned in interfacial contact with each of the inner wall surfaces 22 is a flat sheet of rigid foam material for providing insulation for the block 10. The first flat insulation member 28 and the second flat insulation member 30 each extends upwardly from the lower surfaces 18 of their respective first section 12 and second section 14 to an upper edge 51 slightly below the respective upper surfaces 16 at the termination of their respective adjacent inner wall surfaces 22. With this construction, there is provided a ledge 40 of cement or concrete between the top edges 51 of each of the first flat insulation member 28 and second flat insulation member 30. The presence of the respective ledges 40 assists in retaining the first and second flat insulation members 28 and 30 snuggly against their respective inner wall surfaces 22 and prevents direct contact against such upper edges 51 of the first and second flat insulation members 28 and 30 by the structure 10 positioned above it, as shown in FIG. 1.

The foam material could be one of a number of well known plastics but preferably is one having an R-value in the range of R5.6 to R8 per inch of thickness such as polyisocyanurate or polyurethane, for example. Foam polystyrene could also be used for those situations in which a lower R-value is acceptable.

As can be seen in FIG. 1, the first and second flat insulation members 28, 30 define an open passageway 32 which is wider in the area adjacent the upper surface 16 than in the area adjacent the lower surface 18. The passageway 32 extends from the first end 34 to the second end 36.

A pair of ⅜ inch reinforcing bars 38 extends across the passageway 32 and through apertures 42 in the respective first and second flat insulation members 28, 30 slightly below the ledges 40. The reinforcing bars 38 extend into the cement or concrete of the respective first and second sections 12, 14 and have down turned elbows 45 for secure engagement to such sections 12, 14.

Also, spanning the passageway 32 in an area approximately midway between the upper surfaces 16 and lower surfaces 18 is a length of polyvinylchloride (PVC) pipe 44 having a diameter (for example about 3") sufficiently large to receive therein cement as it is being introduced into a mold for forming the block 10. The PVC pipe 44 extends through apertures 46 in the respective first and second flat insulation members 28, 30 and extends a short distance into each of the respective first and second sections 12, 14. The reinforcing bars 38 and the PVC pipe 40 are positioned in the respective apertures 42 and 46 of the first and second flat insulation members prior to pouring cement or concrete in the mold used for forming the architectural concrete structure 10. Upon pouring the cement into the mold cavity, the elbows 45 of the reinforcing bar 38 will be encased by the cement and the open ends of the PVC pipe 44 will receive cement sufficiently to completely fill the PVC pipe 44 as shown in the breakaway section of the pipe in FIG. 1.

As will be appreciated, in addition to providing reinforcing, the reinforcing bars 38 maybe used for gripping and lifting the blocks 10.

Figure 2:
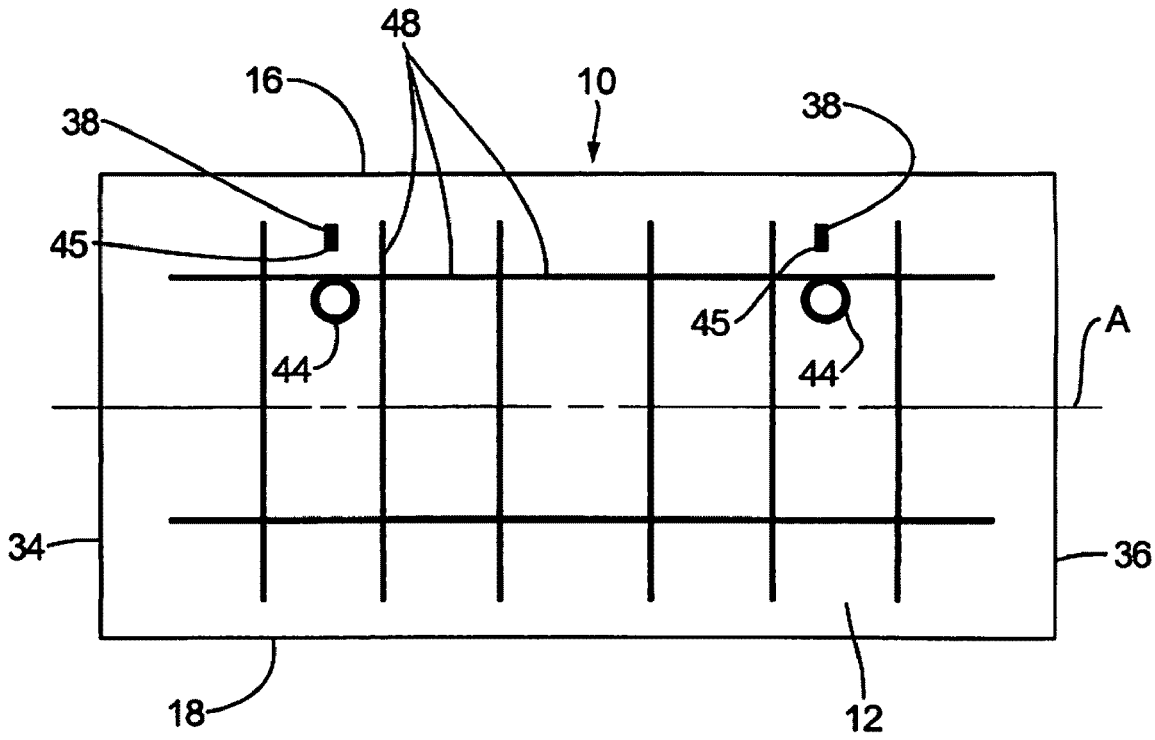
FIG. 2 is a side elevational view partially in section.

There is also provided reinforcing mesh 48 and wires for supporting the mesh during the step of pouring concrete in the mold as shown in FIG. 2. For example, the reinforcing mesh 48 could be 18 gauge wire and spaced apart 6" vertically and horizontally.

If desired, the first section 12 could be poured with concrete of one color and the second section 14 could be poured with a different color thereby permitting a decorative pattern to be formed when constructing a wall simply by having some blocks 10 laid with the first section 12 facing outwardly and other blocks 10 laid with the second section 14 facing outwardly. In addition, various designs or architectural features can be molded or formed on the first section 12 and second section 14. Also grout or mortar can be positioned in the joint between adjacent structures to peal the interface and to provide for a fluid tight use between the structures.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. An architectural structure having a longitudinal axis comprising (a) first and second cement or concrete sections having a first end and a second end, each of said sections having (i) an upper surface parallel to said longitudinal axis;

(ii) a lower surface parallel to said upper surface and to said longitudinal axis;

(iii) an outer wall surface extending from the first end to the second end, the outer wall surface extending between and at substantially right angles to said upper surface and said lower surface, and (iv) an inner wall surface extending from the first end to the second end, the inner wall surface extending upwardly from said lower surface at an acute angle to said lower surface;

(b) one or more reinforcing bars, each having a first end embedded in said first section and a second end embedded in said second section, said one or more reinforcing bars being positioned to lift said architectural structure;

(c) one or more hollow tubes, each having a first end embedded in said first section and a second end embedded in said second section, the hollow tubes being filled with the same cement or concrete used to form the first and second cement or concrete sections and the cement or concrete filling the one or more hollow tubes being integral with the cement or concrete of the first and second cement or concrete sections; and (d) first and second insulation members, said first insulation member being in interfacial engagement with the inner wall surface of said first section and said second insulation member being in interfacial engagement with the inner wall surface of said second section, said reinforcing bars and said hollow tubes extending through said first and second insulation members.

2. The architectural structure of claim 1 wherein each of said first and second sections extend from a first end to a second end and wherein said first and second insulation members are spaced apart and define a passageway extending from said first end to said second end.

3. The architectural structure of claim 1 wherein said first and second insulation members each extending upwardly at said acute angle to a top edge spaced downwardly from said upper surface.

4. The architectural structure of claim 2 wherein said passageway is open at said upper surface and at said lower surface.

5. The architectural structure of claim 1 wherein said first and second insulation members are foam plastic.

6. The architectural structure of claim 1 wherein the outer surface of said first section is a different color than the outer surface of said second section.

7. The architectural structure of claim 1 further including wire reinforcing mesh in each of said first and second sections.

8. In combination, a first architectural structure and a second architectural structure according to claim 1 stacked one on top of the other wherein the lower surface of the upper one of said blocks overlies the first and second insulation members of the lower one of said architectural structure.

9. The combination according to claim 8 wherein, for each of said architectural structure, the outer surface of said first section is a first color and the outer surface of said second section is a different color and one of said architectural structure is positioned with said first section facing in one direction and the other of said architectural structure is positioned with said second section facing said one direction.

10. The architectural structure of claim 1 wherein the one or more reinforcing bars have turned down elbows for secure engagement with the first and second cement or concrete sections.

11. The architectural structure of claim 1 wherein the first and second cement or concrete sections form a ledge of cement or concrete adjacent the top edges of the first and second cement or concrete sections.

12. The architectural structure of claim 11 wherein the first and second insulation members engage the ledge on the first and second cement or concrete sections.

13. A wall system comprising a plurality of architectural structures, each said architectural structure having a longitudinal axis and including:

(a) first and second cement or concrete sections having a first end and a second end, each of said sections extending from a first end to a second end and having (i) an upper surface parallel to said longitudinal axis;

(ii) a lower surface parallel to said upper surface and to said longitudinal axis;

(iii) an outer wall surface extending from the first end to the second end, the outer wall surface extending between and at substantially right angles to said upper surface and said lower surface, and (iv) an inner wall surface extending from the first end to the second end, the inner wall surface extending upwardly from said lower surface at an acute angle to said lower surface;

(b) one or more reinforcing bars, each having a first end embedded in said first section and a second end embedded in said second section, said one or more reinforcing bars being positioned to lift said architectural structure;

(c) one or more hollow tubes, each having a first end embedded in said first section and a second end embedded in said second section, the hollow tubes being filled with the same cement or concrete used to form said first and second cement or concrete sections and the cement or concrete filling the one or more hollow tubes being integral with the cement or concrete of the first and second cement or concrete sections; and (d) first and second insulation members, said first insulation member being in interfacial engagement with the inner wall surface of said first section and said second insulation member being in interfacial engagement with the inner wall surface of said second section, said first and second insulation members being spaced apart and defining a passageway extending from the first end to the second end of said first and second sections;

said reinforcing bars and said hollow tubes extending through said first and second insulation members some of said architectural structure stacked one on top of the other wherein the lower surface of the upper one of said architectural structure overlies the first and second insulation members of the lower one of said architectural structure.

14. The wall system of claim 13 wherein said first and second insulation members are foam plastic.

15. The wall system of claim 13 wherein said first and second insulation members each extends upwardly at said acute angle to a top edge spaced downwardly from said upper surface and further including a ledge between said top edge and said upper surface.

16. The wall system of claim 13 wherein at least some of the building architectural structure have the outer surface of their first sections a different color than the outer surface of their second sections.

17. The wall system of claim 13 wherein the architectural structure further include wire reinforcing mesh in each of said first and second sections.

18. The wall system of claim 13 including architectural structure wherein the outer surface of said first section is a different color than the outer surface of said second section and some of said architectural structures are positioned with said first section facing in one direction and others of said structures are positioned with said second section facing said one direction.

19. The wall system of claim 13 wherein the one or more reinforcing bars have turned down elbows for secure engagement with the first and second cement or concrete sections.

20. The wall system of claim 13 the first and second cement or concrete sections form a ledge of cement or concrete adjacent the top edges of the first and second cement or concrete sections.

21. The wall system of claim 20 the first and second insulation members engage the hedge on the first and second cement or concrete sections.

22. The wall system of claim 21 wherein the ledge prevents direct contact between the upper edges of the first and second insulation member on adjacent stacked architectural structures.

* * * * *